US009708151B2

(12) United States Patent
Griesshammer

(10) Patent No.: US 9,708,151 B2
(45) Date of Patent: Jul. 18, 2017

(54) BOBBIN WINDING MACHINE

(75) Inventor: Christian Griesshammer, Winterthur (CH)

(73) Assignee: Maschinefabrik Rieter AG, Winterthur (CH)

( * ) Notice: Subject to any disclaimer, the term of this patent is extended or adjusted under 35 U.S.C. 154(b) by 597 days.

(21) Appl. No.: 14/232,674

(22) PCT Filed: Jun. 29, 2012

(86) PCT No.: PCT/CH2012/000141

§ 371 (c)(1),
(2), (4) Date: Jun. 10, 2014

(87) PCT Pub. No.: WO2013/010280

PCT Pub. Date: Jan. 24, 2013

(65) Prior Publication Data

US 2014/0284415 A1 Sep. 25, 2014

(30) Foreign Application Priority Data

Jul. 15, 2011 (CH) ..... 1186/11

(51) Int. Cl.

| | |
|---|---|
| ***B65H 54/74*** | (2006.01) |
| ***B65H 54/28*** | (2006.01) |
| ***D01H 7/92*** | (2006.01) |
| ***D01H 1/36*** | (2006.01) |
| ***B65H 54/54*** | (2006.01) |
| ***B65H 67/048*** | (2006.01) |

(52) U.S. Cl.

CPC ..... *B65H 54/74* (2013.01); *B65H 54/28* (2013.01); *B65H 54/543* (2013.01); *B65H 67/048* (2013.01); *D01H 1/36* (2013.01); *D01H 7/92* (2013.01); *B65H 2701/31* (2013.01)

(58) Field of Classification Search

None

See application file for complete search history.

(56) References Cited

U.S. PATENT DOCUMENTS

| | | | | |
|---|---|---|---|---|
| 4,375,278 A | | 3/1983 | Beeck | |
| 4,429,838 A | | 2/1984 | Lenk et al. | |
| 4,514,349 A | * | 4/1985 | Lipschitz | B65H 54/72 264/103 |

(Continued)

FOREIGN PATENT DOCUMENTS

| | | |
|---|---|---|
| CN | 1088538 | 6/1994 |
| CN | 101058376 | 10/2007 |

(Continued)

OTHER PUBLICATIONS

Machine Translation of DE 27 07 695, Nov. 3, 1977.*
Swiss Patent Office Search Report, Jan. 17, 2012.
PCT Search Report, Sep. 21, 2012.

*Primary Examiner* — William E Dondero
(74) *Attorney, Agent, or Firm* — Dority & Manning, P.A.

(57) ABSTRACT

A device and a method for winding a roving onto bobbin tubes using a turret winding head is provided. The turret winding head has a turret base plate having a first and a second spindle that are held in the turret base plate and are provided for receiving the bobbin tubes. The turret base plate and the spindles are each provided with their own drive. The longitudinal axes of the spindles are aligned in the vertical direction.

7 Claims, 1 Drawing Sheet

(56) References Cited

U.S. PATENT DOCUMENTS

| | | | | | |
|---|---|---|---|---|---|
| 5,489,067 | A * | 2/1996 | Nakai | B65H 54/2893 | |
| | | | | 242/474.5 | |
| 5,676,323 | A * | 10/1997 | Wirz | B65H 54/72 | |
| | | | | 242/473.5 | |
| 6,286,778 | B1 | 9/2001 | Kudrus | | |
| 8,042,324 | B2 | 10/2011 | Griesshammer et al. | | |
| 2006/0207238 | A1 | 9/2006 | Cherif | | |

FOREIGN PATENT DOCUMENTS

| | | |
|---|---|---|
| DE | 27 07 695 | 11/1977 |
| DE | 10 2009 012 001 A1 | 10/2009 |
| EP | 0 927 696 A1 | 7/1999 |
| JP | 50-154665 | 12/1975 |
| JP | 873129 | 3/1996 |
| JP | 2003-49333 | 2/2003 |

* cited by examiner

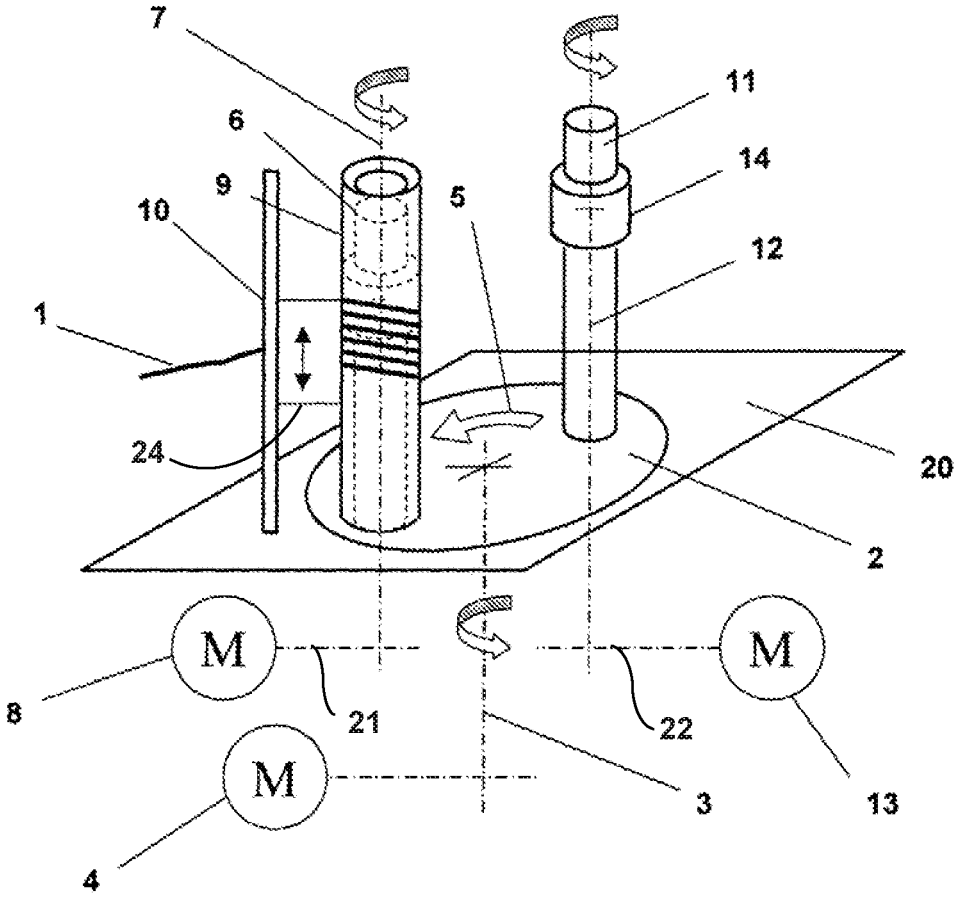
7
6
9
10
1
24
5
11
14
12
20
2
M
M
M
8
21
22
3
13
4

BOBBIN WINDING MACHINE

BACKGROUND

The invention relates to a device for winding a roving onto bobbin tubes using a turret winding head.

With roving machines, so-called rovings or slivers are produced, which are used as feed for spinning a fiber yarn, for example, on a ring spinning machine. The roving serving as feed for ring spinning machines is usually produced from a drafter sliver that is drafted on a drafting arrangement of the roving machine and is subsequently provided with a slight twist so that the roving can be wound onto a bobbin in a draft-free manner. The imparted twist must only be to such an extent that the coherence of the fibers is strong enough for winding and unwinding again and transport of the bobbins. On the other hand, with regard to the draft on the ring spinning machines, this so-called producer twist has to be so little that in the further production process, no drafting faults occur. The roving has to be draftable despite the applied producer twist.

For producing the roving, so-called flyers are used as a roving machine. The flyer is typically equipped with a drafting arrangement and a spindle for winding the roving onto a flyer tube by means of a flyer. For process-related reasons, the flyer tubes or, respectively, the spindles for receiving the flyer tubes are aligned vertically. Imparting the producer twist via the flyer and unwinding the roving takes place in one process step in which the spindle rotates with the flyer tube located thereon, and the flyer guiding the sliver to the flyer tube rotates around the flyer tube. Nowadays, the finished bobbins are removed from the roving machine by means of automatic doffers and are delivered in automatic displacement systems out of the flyer and are fed to the ring spinning machines for further processing.

However, in the meantime, forms of roving machines other than the conventional flyers have become known, which have in common that a producer twist is imparted to the roving in a twisting means downstream of the drafting arrangement. The roving with the producer twist is subsequently fed to a winding device. Imparting the producer twist and winding the roving is carried out in two process steps, which are independent of each other. Accordingly, in such roving machines, winding devices can be used other than is the case in a flyer.

Such a winding device is disclosed in EP 2 112 258. The construction of the disclosed winding device takes account of the high delivery speeds of the roving machine. However, the winding device according to EP 2 112 258 has the disadvantage that for replacing a full bobbin with an empty tube, the winding process and therefore the delivery of the roving from the twisting means has to be interrupted. Depending on the embodiment of the twisting means, piecing after an interruption means loss in productivity and quality.

When using conventional flyer tubes in a roving machine according to EP 2 112 258, due to the high delivery rates of 600 m/min and higher, very frequent tube changes are necessary. Therefore, a winding device according to EP 2 112 258 is not suited for the use of flyer tubes. Flyer tubes according to the prior art are disclosed, for example, in EP 0 927 696. A flyer tube is a tube having an outer casing surface and an inner casing surface. The outer casing surface serves for winding thereon roving from a fiber material and has a region with a starter strip or another device for receiving the roving end at the beginning of the winding after a bobbin change. The inner casing surface is formed such that it is suitable in terms of size and shape to be received by transport means known from the prior art for transporting full or empty tubes, or to be received in devices for further processing the roving.

From the production of chemical fibers, winding machines are known that are suitable for continuously fed threads. Such a winding machine is disclosed, for example, in EP 1 053 967. The winding machine has a turret winding head on which two bobbin chucks are held. A first bobbin chuck is in a winding position and a second bobbin chuck is in a doffer position. In the doffer position, the full bobbins are removed from the bobbin chuck and replaced by an empty tube. If the bobbins in the winding position are full, the turret is rotated by 180° and the bobbin chucks change position. The incoming threads are separated from the full bobbins without the delivery being interrupted by the performed rotation, and are taken over by the empty tubes. The bobbin chucks are arranged horizontally. Moreover, due to the traversing mechanism, the threads are not wound in a draft-free manner. The thread guide, from which the thread changes to the traversing mechanism, is spaced at a certain distance from the traversing mechanism itself. Through this, the path for the thread from the thread guide to the outermost position of the traversing mechanism is longer than it is when the traversing mechanism is in the middle position. Because of this, each movement of the traversing mechanism results in a certain draft.

SUMMARY OF THE INVENTION

It is therefore an object of the present invention to provide a device for winding a roving, which enables interruption-free and draft-free winding of a roving and thereby does not exclude the use of conventional flyer tubes. Additional objects and advantages of the invention will be set forth in part in the following description, or may be obvious from the description, or may be learned through practice of the invention.

The objects are achieved by a device for winding a roving using a turret winding head with the features according to the present invention. The turret winding head consists of a turret base plate including two spindles having a longitudinal axis, the spindles being held in the turret base plate and provided for receiving the bobbin tubes. The turret base plate and each of the spindles are provided with their own drives. The longitudinal axes of the spindles are aligned vertically.

The device for winding the roving can be viewed independently from the production of the roving since no mechanical connection between the winding device and the roving spinning machine is required. It is only necessary to establish connections for control purposes since the operation of the winding device depends on the delivery of the roving to be wound. The device comprises a turret base plate which is rotatably mounted in a horizontal position in a machine frame. The turret base plate is rotated by a drive, preferably an electric drive, by half a revolution (180°) for each bobbin change. The rotation or, respectively, the bobbin change can be initiated by a roving length measurement or based on a given winding time. Other indicators such as, for example, the bobbin diameter are also conceivable. Through the rotation of the turret base plate, an empty bobbin tube is fed to the winding mechanism, and the roving to be wound is taken over by this empty bobbin tube. Thus, it is not necessary to interrupt the roving supply during a tube change. An interruption-free winding process and therefore an interruption-free roving production is possible.

Two spindles for receiving the bobbin tubes are held and rotatably mounted in the turret base plate. The spindles are held in a protruding manner in the turret base plate and can be loaded from the free end opposite to the bearing with bobbin tubes. The spindles are arranged opposite to one another on the turret base plate. Each of the two spindles is provided with its own drive. The drive preferably comprises an electric motor having a first gear stage and a chain or belt drive for power transmission to the spindle. The chain or belt drive enables that during a rotation of the turret base plate, the spindles held therein change their position while the associated drive remains unchanged in its position. However, it is also conceivable to mount the drives directly on the spindles and to provide adequate rotary transmitters for the required energy. Such rotary transmitters are known from the prior art.

The spindles are aligned with their longitudinal axes in the vertical direction. This allows that the flyer tubes known from the prior art can be used as bobbin tubes. Thus, there is compatibility of the bobbins produced by means of the winding device with the flyer tubes used in spinning mills. Such flyer tubes have a cylindrical outer casing surface that serves for winding a roving thereon. The flyer tube is supported in a known manner on the spindle. Preferably, a fastening element is provided in the upper third of the spindle. As in the case of a convention flyer, the tubes are held in the lower region of the spindle in the turret base plate and are fixed by the fastening element in the upper region of the spindle. This results in a sufficient true running of the tubes even at high speeds. Preferably, the fastening elements are provided as pneumatic clamping devices. The bobbin sleeves are held rotationally fixed on the spindles by the mounting in the turret base plate and by the fastening elements.

The roving is fed via traversing means to the bobbin tube that is set into rotation. The traversing means substantially consist of a holder fixedly connected to the machine frame and an element that is movable along the longitudinal axis of the bobbin tube. Due to their construction, the traversing means allow a draft-free winding of the drafting yarn. As the movable element of the traversing means, for example, pressing fingers or pairs of winding delivery rollers can be provided. The construction of pressing fingers is generally known from the flyer technology. For forming an exemplary pair of winding delivery rollers, reference is also made to the prior art, namely to EP 2 112 258.

The rotational speed of the spindles and therefore of the bobbin tubes is determined by the delivery speed of the roving. Producing the roving can be carried out, for example, by using an air-jet spinning method. The delivery of the roving from the production can take place directly to the winding mechanism, for example, through guides. The device for winding the roving also has guides for taking over the roving. Controlling the rotational speed of the spindle onto which the roving is wound can be controlled by means of the speed of the roving fed. For this purpose, suitable sensors would have to be provided. However, the roving is preferably brought through the guides in such a manner that the roving freely sags between leaving the roving production and reaching the winding mechanism. If a difference in speed between production and winding occurs, the sag changes. Accordingly, the required speed of the spindle can be controlled by a sagging sensor. In this manner, the change in the circumferential speed due to the increase of the bobbin diameter at the winding point is also taken into account.

Furthermore, the invention also comprises a method for winding roving onto bobbin tubes by using the device according to the invention. The method is characterized in that the first spindle is in a winding position and the second spindle is in a doffer position. In the winding position, roving is wound onto the bobbin tube, for which reason the drive of the spindle in the winding position is in operation. In the doffer position, a full bobbin is removed and an empty bobbin tube is put onto the spindle. Thus, the drive of the spindle in the doffer position is out of operation. By rotating the turret base plate, the first and second spindles change positions. Accordingly, the operating states of the drives of the spindles are changed. The first spindle, which now has a full bobbin tube, is moved away from the traversing means through the rotation of the turret base plate. At the same time, the second spindle, which has an empty bobbin tube, is moved towards the traversing means. Once the second spindle has reached the traversing means, the roving is transferred onto the empty bobbin tube and is detached from the full bobbin tube. For this purpose, the empty bobbin tubes are provided with a catch device that allows receiving the roving. From the prior art it is known to provide the flyer tubes with a hook-and-loop tape in a limited area. The hook-and-loop tape effects that the roving is taken over by the empty bobbin tube as soon as the roving touches the hook-and-loop tape. A soon as the roving is received by the empty bobbin tube of the second spindle, the rotation of the first spindle carrying the full bobbin tube is stopped, and the full bobbin tube is replaced by an empty bobbin tube.

Advantageously, through the rotation of the turret base plate, the empty bobbin tube is rotated into the path of the roving, which path leads from the traversing means to the full bobbin tube. In order to increase the reliability of such a bobbin change, it is also possible to use guiding means which guide the roving towards the transfer point during the rotation of the turret base plate, or effect a greater wrapping of the empty bobbin tube.

The rotation of the turret base plate also effects that the roving is disconnected from the full bobbin and is taken over by the new empty bobbin tube. This procedure enables an interruption-free winding operation. Also, it is not necessary to adjust the delivery speeds of the roving, which are determined by the production device, during a changing process. The result is a stable and trouble-free operation with continuous output.

DETAILED DESCRIPTION

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

The invention is explained in greater detail below based on FIG. 1.

FIG. 1 shows a schematic illustration of a turret winding head. A turret base plate 2 is held and rotatably mounted in a machine frame 20. The turret base plate 2 is arranged horizontally and has a vertical rotational axis 3. The turret base plate 2 is rotated by a drive 4 about the rotational axis 3 in steps of 180°, according to arrow 5. A first spindle 6 and a second spindle 11 are held and rotatably mounted in the turret base plate 2. The first spindle 6 is connected to a drive 8 via the rotational axis 7 by a gear and belt/chain drive 21 schematically depicted in FIG. 1. The second spindle 11 is connected to the drive 13 via the rotational axis 12 by a gear and belt/chain drive 22 depicted schematically in FIG. 1. The first and the second spindles 6, 11 are operated independently of each other. Advantageously, the drives 8, 13 of the first and second spindles 6, 11 are equipped with a frequency control.

In the illustration of FIG. 1, the first spindle 6 is in the winding position. An empty bobbin tube 9 is put onto the spindle 6. A roving 1 is wound onto the bobbin tube 9. The roving 1 is wound via the traversing means 10 onto the bobbin tube 9. The traversing means 10 are connected to the machine frame 20 and are held by the latter. The traversing means 10 comprise a movable element which moves up and down along the bobbin tube 9 with a pressing finger 24 resulting in a uniform wrapping of the bobbin tube 9 which rotates about the rotational axis 7.

In the illustration of FIG. 1, the second spindle 11 is in the duffer position. The full bobbin tube has already been removed from the second spindle 11. Removing full bobbin tubes and putting on empty bobbin tubes can be carried out automatically by suitable manipulators or robots. In its upper region, the spindle 11 is provided with a fastening element 14. The fastening element 14 serves for stabilizing a bobbin tube 9 on the spindle 11. An empty bobbin tube 9 is put from above onto the spindle 11 and is subsequently held in a rotationally fixed manner by the fastening element 14. The fastening element 14 can be, for example, a pneumatic clamping device which, after the bobbin tube is put on, is depressurized and thereby undergoes a radial expansion, as a result of which the bobbin tube is firmly clamped on the spindle 11.

When the bobbin tube 9 is provided with a full winding, the turret base plate 2 is rotated by the drive 4 about the axis 3 thereof by a half a revolution (180°) in the arrow direction 5. Thereby, the first and second spindles 6, 11 change positions. The traversing means 10 are not carried along with the rotation of the turret base plate 2. Through the rotation of the turret base plate 2, the empty bobbin tube 9, which is placed on the second spindle 11, is rotated into the winding position and therefore into the path of the roving 1. Thereby the roving 1 is taken over by the empty bobbin tube and detached from the full bobbin tube. For transferring the roving 1 to the empty bobbin tube, the bobbin tube is provided at a certain place with a catch device. The roving 1 is guided by the traversing means 10 to the place of this catch device. As soon as the roving 1 has been taken over by the empty bobbin tube, the traversing means 10 begin to uniformly wind to roving 1 onto the empty bobbin tube by means of a controlled up and down movement.

Modifications and variations can be made to the embodiments illustrated or described herein without departing from the scope and spirit of the invention as set forth in the appended claims.

REFERENCE LIST

1 Roving
2 Turret base plate
3 Rotational axis of the turret
4 Drive of the turret
5 Direction of rotation of the turret
6 First spindle
7 Rotational axis of the first spindle
8 Drive of the first spindle
9 Bobbin tube
10 Traversing means
11 Second spindle
12 Rotational axis of the second spindle
13 Drive of the second spindle
14 Fastening element
20 Machine frame

The invention claimed is:

1. A device for winding a roving onto bobbin tubes, comprising:

a turret winding head, the turret winding head further comprising a rotatable turret base plate, the turret base plate having a drive associated therewith;

a first spindle and a second spindle disposed on the turret base plate and configured to receive bobbin or flyer tubes thereon, the spindles having a vertically aligned longitudinal axis, the first and second spindles rotatably mounted directly on the turret base;

a first drive for the first spindle, and a second drive for the second spindle, the first drive and the second drive being separate from the first spindle and the second spindle, respectively, and independently controlled, the first drive and the second drive stationarily fixed so as not to rotate with the turret base plate;

the first drive and the second drive comprising a gear and one of a belt or chain drive connected directly to the respective spindle for direct power transmission to the respective spindle, and a fastening element provided on an upper third of each of the first spindle and the second spindle for secure engagement with a bobbin or flyer tube thereon.

2. The device as in claim 1, wherein the fastening element comprises a pneumatic clamping device.

3. The device as in claim 1, further comprising a traversing device stationarily fixed relative to the turret base plate, the traversing device movable vertically along the longitudinal axis of one of the first or second spindles in an operating winding position depending on a rotated position of the turret base plate.

4. The device as in claim 3, wherein the traversing device is mounted on a machine frame, the turret base plate rotatable relative to the machine frame.

5. The device as in claim 4, wherein the traversing device comprises a pressing finger.

6. The device as in claim 4, wherein the first drive and the second drive are frequency controlled drives.

7. A method for winding a roving onto a bobbin or flyer tube, the method comprising: using a turret winding head that includes a rotatable turret base plate, a first spindle and a second spindle disposed on the turret base plate and configured to receive the bobbin or flyer tubes thereon, the first and second spindles rotatably mounted directly on the turret base, and a first drive for the first spindle, and a second drive for the second spindle, the first drive and the second drive being separate from the first spindle and the second spindle, respectively, and independently controlled, the first drive and the second drive stationarily fixed so as not to rotate with the turret base plate, the first drive and the second drive having a gear and one of a belt or chain drive connected directly to the respective spindle for direct power transmission to the respective spindle, and a fastening element provided on an upper third of each of the first spindle and the second spindle for engagement with a bobbin or flyer tube thereon;

rotating the turret base plate to a position wherein the roving is wound onto a bobbin or flyer tube on the first spindle and the second spindle is in a doffer position;

removing a full bobbin or flyer tube from the second spindle;

placing an empty bobbin or flyer tube onto the second spindle; and when the bobbin or flyer tube on the first spindle is full, rotating the turret base plate to place the first spindle in the doffer position and to place the second spindle in a winding position.

* * * * *